United States Patent [19]

Andrews

[11] 4,076,010

[45] Feb. 28, 1978

[54] FACTORY-BUILT FIREPLACE SPACER CONSTRUCTION

[75] Inventor: George M. Andrews, Syracuse, N.Y.

[73] Assignee: Vega Industries, Inc., Syracuse, N.Y.

[21] Appl. No.: 739,442

[22] Filed: Nov. 8, 1976

Related U.S. Application Data

[63] Continuation of Ser. No. 597,394, July 18, 1975, abandoned.

[51] Int. Cl.[2] ..... F24B 1/18

[52] U.S. Cl. ..... 126/120; 126/65

[58] Field of Search ..... 126/120, 121, 123, 114, 126/118, 62, 65; 52/36

[56] References Cited

U.S. PATENT DOCUMENTS 70,233 10/1867 Liddle ..... 126/123

1,858,967 5/1932 Pettiegrew ..... 126/120

*Primary Examiner*—Ronald C. Capossela

*Attorney, Agent, or Firm*—Charles S. McGuire

[57] ABSTRACT

A factory-built fireplace having movable spacer members associated therewith for insuring a necessary minimum clearance between portions of an outer surface of the fireplace and combustible structural members used for permanent enclosure thereof. The spacer members are formed from a single sheet or plate of metal and associated with the outer wall of the fireplace so as to be movable between folded and erected positions. When folded, as during packing and shipping, no portion of the spacer members extends an appreciable distance outwardly of the outer fireplace surface, and when erected for installation the edges of the spacer members define the closest position at which combustible framing members may be placed to the outer fireplace surface.

10 Claims, 6 Drawing Figures

FACTORY-BUILT FIREPLACE SPACER CONSTRUCTION

CROSS REFERENCE TO RELATED APPLICATIONS

This application is a continuation of Ser. No. 597,394 filed July 18, 1975 now abandoned.

BACKGROUND OF THE INVENTION

The present invention relates to factory-built fireplaces and, more particularly, to structure associated with such fireplaces to assist in proper installation and enclosure thereof in a building where the fireplace is to be used.

One type of fireplace in common use today is the so-called factory-built fireplace, which is fabricated largely from sheet metal and shipped ready for installation in the home or other building in which it is to be used. The fireplace is normally enclosed on the top, sides and rear by portions of the building structure, which may comprise combustible materials. In certain areas of the fireplace the outer shell thereof may be enclosed by the combustible materials with zero clearance therebetween. In other areas, however, usually the top of the fireplace, around the upper hood or chimney, the combustible materials must be spaced from the outermost wall of the fireplace in order to insure that an unsafe condition does not occur.

Although installation instructions may advise that a certain minimum clearance must be provided in certain areas, it is always possible that such instructions may be overlooked and the combustible framing members placed too close to the fireplace. External members may be provided on the exterior of the fireplace in the areas where minimum clearance must be provided, the position and spacing of such members insuring that the combustible materials are not placed closer than the allowable distance from the fireplace wall. However, such members necessarily extend beyond the outer shell or walls of the fireplace, increasing the external dimensions and therefore the cost of packing and shipping.

It is a principal object of the present invention to provide a factory-built fireplace having associated therewith spacing members which insure a minimum clearance between the exterior of the fireplace and combustible members by which it is enclosed, wherein the spacing members do not add to the external dimensions of the fireplace for packing and shipping purposes.

A further object is to provide a factory-built fireplace having associated spacing members movable between folded and erected positions wherein both fabrication of the spacing members and assembly thereof with the fireplace structure is expedient and economical.

Another object is to provide the aforementioned fireplace spacing members in a construction wherein they are movable with respect to the fireplace wall about an axis, but are connected thereto by a simpler and cheaper means than a conventional hinged connection.

A still further object is to provide a factory-built fireplace having external spacing members which may be positioned for packing and shipment so that there is essentially no possibility of structural damage to the spacer members themselves or to other portions of the same or adjoining fireplace units by the spacer members.

Other objects will in part be obvious and will in part appear hereinafter.

SUMMARY OF THE INVENTION

In accordance with the foregoing objects, the invention comprises a factory-built fireplace unit having an outer shell or casing, the upper wall of which must be spaced at least a minimum distance from combustible materials in which the fireplace is enclosed. A plurality of spacer members are associated with the upper wall and are movable with respect thereto between folded and erected positions. In the folded position, the portions of the spacer members on the exterior of the fireplace lie essentially flat against the external wall thereof and do not materially add to the external dimensions of the fireplace. Therefore, packing and shipping may be effected without regard to the spacer members.

The spacer members are formed from a single metal sheet or plate, bent at approximately 90° to form first and second portions on opposite sides of the bend. One portion is wider than the other where the two meet at the bend, and the other portion is again bent back upon itself at slightly less than 180°, thus forming two superposed layers.

A slot is formed in the sheet metal wall of the fireplace having a length greater than the length of the narrow portion if the spacer member and less than the length of the wider portion at the juncture of the two. Thus, the longer portion cannot pass through the slot, but the narrower portion can. The width of the slot is greater than the combined thickness of the two superposed layers of the other portion when these layers are pressed together, but less than the total thickness of the two layers when undistorted. The natural resiliency of the material tends to restore it to the configuration in which it is formed.

In assembling the spacer members with the fireplace, the portion bent back upon itself is passed through the slot in the fireplace wall by pressing the two layers together. When the layers are released after passing through the slot, the natural resilience of the material returns it to its undistorted configuration. The spacer member is prevented from entering the slot beyond the area of the 90° bend by the width of the first portion of the spacer member at the bend being greater than the length of the slot. Although the narrower portion of the spacer member may be forced through the slot, it may not normally be withdrawn again since the free edge of the portion bent back upon itself will not start through the slot due to the width thereof being substantially less than the total thickness dimension of that portion of the spacer member which includes the two layers in the area of the free edge.

Thus, the spacer member is not directly affixed to the fireplace wall, but has a portion extending through a slot therein, the relative sizes of the spacer member and slot being such that the spacer member may not be inserted into the slot past the 90° bend and may not be withdrawn from the slot after insertion. The spacer member may be rotated about an axis through the 90° bend for a distance of approximately 90°. When placed in the erected position, an additional portion, extending rigidly from the first portion, may be secured by a screw to a cooperatively positioned surface of the fireplace unit to maintain the spacer member in the erect position.

DETAILED DESCRIPTION

Figure 1:
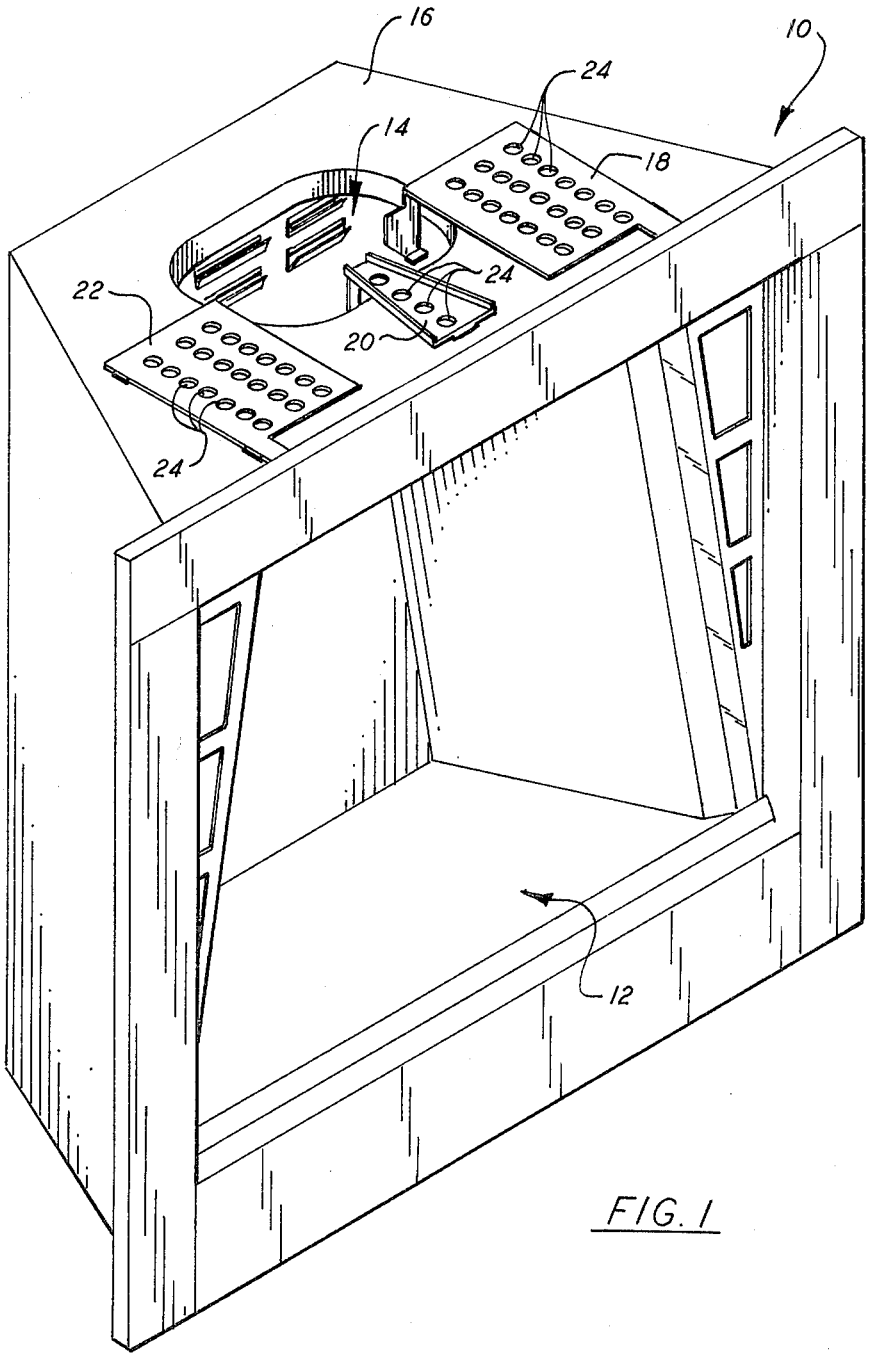
FIG. 1 is a perspective view of a factory-built fireplace unit incorporating the spacer members of the present invention shown in the folded position.

Referring now to the drawings, in FIG. 1 is shown a factory-built fireplace unit 10 including frontal opening 12 for the combustion chamber and flue opening 14 in the upper wall for connection with a chimney. Fireplace unit 10 may take the form of virtually any factory-built fireplace which requires a clearance between some portion of the outermost surface of the fireplace and combustible materials by which it is permanently enclosed. A sheet metal shell defines the outermost surface of unit 10 on the sides, back and top, the top wall being designated by reference numeral 16. In the present discussion, it is assumed that unit 10 may be installed with zero clearance to combustibles at the sides and rear, but at least a minimum clearance is required between top wall 16 and framing members or other combustible enclosure materials.

Figure 2:
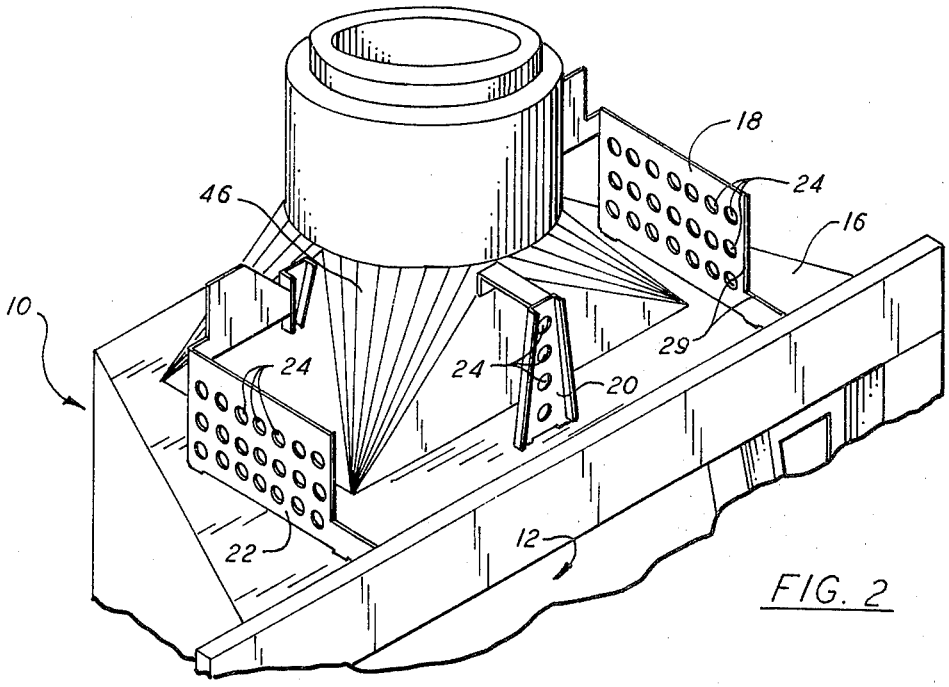
FIG. 2 is a perspective view of a portion of FIG. 1 with the spacer members in the erected position.

Associated with top wall 16 in a manner explained later in detail are spacer members 18, 20 and 22. Each of these spacer members is movable with respect to top wall 16 between folded and erected positions, in which the spacer members are shown in FIGS. 1 and 2, respectively. The spacer members are formed of sheet metal and are provided with openings 24 in order to break up the path of heat conduction through the members, in accordance with conventional practice. Openings 24 also permit freer movement of the air in the space above the top of the of the fireplace which is completely enclosed after installation. When in the erected position of FIG. 2, spacer members 18, 20 and 22 define the closest limits at which combustible framing members used in the installation and enclosure of fireplace unit 10 may be placed with respect to top wall 16. An example of such framing members are shown in section in FIG. 3, designated by reference numeral 26.

Figure 3:
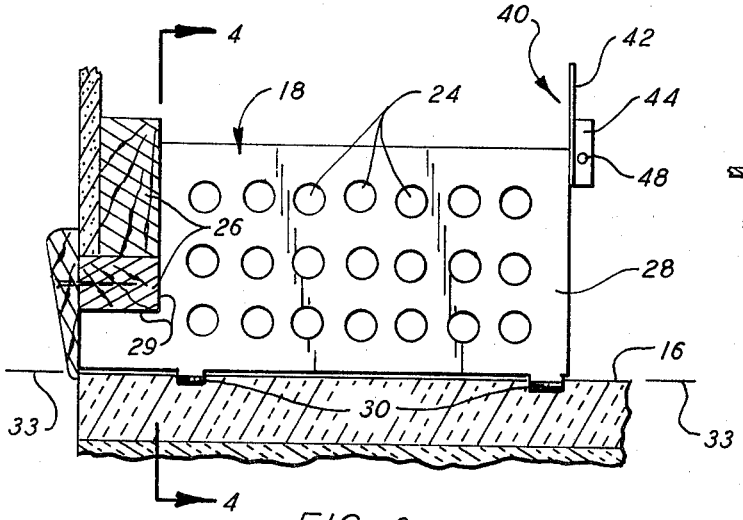
FIG. 3 is a side elevational view of one of the spacer members in the erected position with fragments of the fireplace wall and framing members shown in section.
Figure 4:
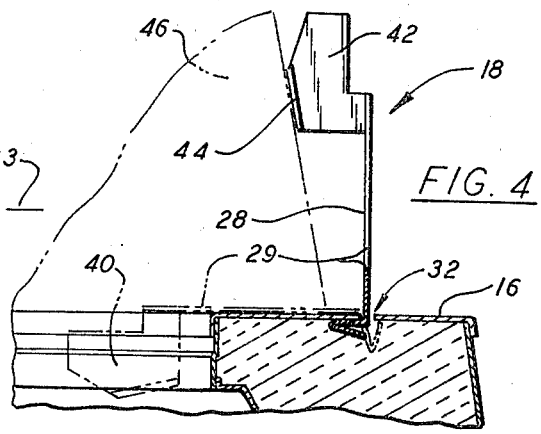
FIG. 4 is an end elevational view, in section on the line 4—4 of FIG. 3.

Referring now to FIGS. 3 and 4, spacer member 18 is illustrated in greater detail and is identical to spacer members 20 and 22 in all respects material to the present invention. Spacer member 18 is formed from a single blank of sheet metal, as are the other spacer members, which is bent to form three basic portions. The major or first portion 28 provides, in the erected position, the structure on the outside of wall 16 having edges 29 against which the framing members 26 or other fireplace enclosure materials abut. One or more second portions 30 extend from first portion 28 through elongated slots or openings 32 in fireplace top wall 16. Second portions 30, seen in FIGS. 3–6, are bent at approximately 90° with respect to first portion 28 along line or axis 33 (FIG. 3) where the two portions meet. Second portions 30 are again bent back upon themselves at an angle of somewhat less than 180° to form superposed layers 34 and 36, the latter having free edge 38.

The third portion of spacer member 18, denoted generally by reference numeral 40, may also be conveniently formed from the same blanks as the other portions, and in any case extend rigidly from first portion 28. Portion 40 includes tab 42, bent at approximately 90° with respect to first portion 28, and ear 44, bent from tab 42 at 90°, or other appropriate angle to lie flat against an exterior surface of chimney structure 46 when the spacer member is in the erected position. Opening 48 in ear 44 is aligned with a similar opening (not shown) in chimney structure 46 so that the spacer member may be secured in the erected position by a screw passing through opening 48 and fastened to the chimney. As seen in FIG. 1, when the spacer members are in the folded position all of the third portions extend downwardly into flue opening 14, whereby no portion of the spacer members extends appreciably beyond top wall 16 of fireplace unit 10.

Figure 5:
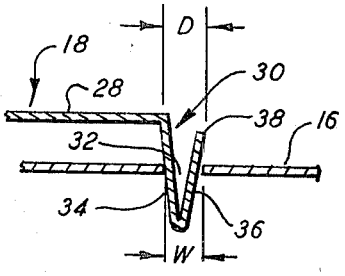
FIG. 5 is an enlarged end elevational view of a fragment of the spacer member of FIGS. 3 and 4, shown during assembly thereof with the fireplace unit.

The spacer members are assembled to wall 16 by pushing portions 30 through slots 32. The dimension D (FIG. 5), representing the width of portions 30 in the natural or undistorted state is greater than the width W of slots 32. Thus, in order to pass through the slots, layers 34 and 36 are pressed toward one another as portion 30 is pushed downwardly as seen in FIG. 5. When free edge 38 passes through slot 32 the natural resilience of the sheet metal will return portion 30 essentially to its original, undistorted form, with dimension D larger than W. Thus, once assembled the spacer member cannot be removed from association with the fireplace, although it may be rotated 90° with respect thereto about axis 33. As shown in phantom lines in FIG. 4, first portion 28 lies essentially flat along the upper surface of wall 16 and second portion 30 extends downwardly from the lower side of wall 16 when the spacer member is in its folded position. The spacer member is shown in solid lines in the erected position with portion 28 essentially normal to the plane of wall 16, and layer 34 of second portion 30 lying essentially flat along the lower side of wall 16.

Figure 6:
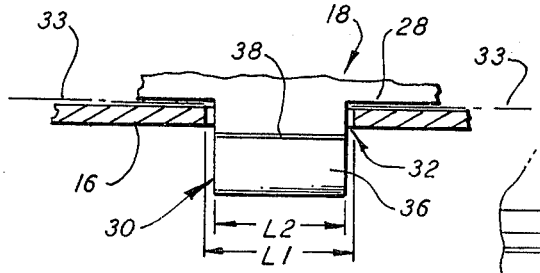
FIG. 6 is an enlarged side elevational view of essentially the same fragment of the spacer member, shown fully assembled with the fireplace unit.

In FIG. 6 is shown a fragment of spacer member 18 including one of second portions 30 with the latter fully extended through opening 32. The length (L1) of opening 32 is, of course, greater than the length (L2) of second portion 30 in order to allow free insertion of the second portion and no other part of the spacer member.

It should be noted that when the spacer members are erected and secured to the base portion of the chimney, they also provide the necessary function of anchoring the chimney to the fireplace unit proper. Thus, erection and securing of the spacer members does not represent any additional installation steps, since some means for anchoring the chimney would have to be provided in any case. Although in the illustrated embodiment spacer member 20 is of somewhat different form than identical members 18 and 22, it includes the same three basic portions, the first portion thereof having side or edge flanges, designated in FIG. 2 by reference numeral 48, having edges against which framing members 26 may abut.

What is claimed is:

1. A factory built fireplace unit for enclosure by combustible framing members and having integral means for insuring minimum clearance distance between an exterior surface of said unit and said framing members, said unit comprising, in combination:

(a) a fireplace unit having an outer shell of sheet metal defining the exterior surface thereof; and (b) a rigid, plate-like spacer member having a straight edge portion and associated with said outer shell for movement with respect thereto about an axis substantially in the plane of said shell between a folded position, wherein no portion of said spacer member extends an appreciable distance beyond said external surface, and an erected position, wherein said edge portion is arranged at a distance from said external surface at least equal to said minimum clearance distance.

2. The invention according to claim 1 wherein said outer shell includes a slotted opening of predetermined length and width, and said spacer member extends through said opening, having a first portion disposed on the side of said shell defining said exterior surface, and a second portion on the opposite side.

3. The invention according to claim 2 wherein said first and second portions are integrally formed from a single sheet of metal and disposed at an angle to one another.

4. The invention according to claim 3 wherein said angle is approximately 90°.

5. The invention according to claim 3 wherein said spacer member is bent along a substantially straight line to define said first and second portions on opposite sides thereof, and said axis is approximately defined by said line.

6. The invention according to claim 5 wherein said first portion is longer and said second portion shorter than the length of said opening where the two portions meet at said line.

7. The invention according to claim 6 wherein said second portion includes a deformable portion having an undeformed dimension wider than the width of said opening and a deformed dimension not greater than the width of said opening, said deformable portion having a natural resilience tending to maintain said undeformed dimension, whereby said second portion may be moved through said opening only when said deformable portion is moved to said deformed dimension and the latter is arranged transversely of said opening.

8. The invention according to claim 7 wherein said deformable portion comprises an integral part of said second portion bent back upon itself at substantially 180° when at said deformed dimension and at less than 180° when at said undeformed dimension.

9. The invention according to claim 8 and further including an additional portion extending rigidly from said first portion, and means fixedly attaching said additional portion to said fireplace unit to maintain said spacer member in said erected position.

10. The invention according to claim 9 wherein said slotted opening is formed in an upper wall of said outer shell, the latter including a flue opening, and wherein said additional portion extends into said flue opening when said spacer member is in said folded position.

* * * * *